US011668522B2

(12) United States Patent
Chen et al.

(10) Patent No.: US 11,668,522 B2
(45) Date of Patent: Jun. 6, 2023

(54) HEAVY HYDROCARBON REMOVAL SYSTEM FOR LEAN NATURAL GAS LIQUEFACTION

(71) Applicant: Air Products and Chemicals, Inc., Allentown, PA (US)

(72) Inventors: Fei Chen, Whitehouse Station, NJ (US); Mark Julian Roberts, Kempton, PA (US); Christopher Michael Ott, Macungie, PA (US); Annemarie Ott Weist, Macungie, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 694 days.

(21) Appl. No.: 15/216,318

(22) Filed: Jul. 21, 2016

(65) Prior Publication Data

US 2018/0023889 A1 Jan. 25, 2018

(51) Int. Cl.

| | |
|---|---|
| ***F25J 3/02*** | (2006.01) |
| ***F25J 1/02*** | (2006.01) |
| ***F25J 1/00*** | (2006.01) |

(52) U.S. Cl.

CPC ..... *F25J 3/0238* (2013.01); *F25J 1/0022* (2013.01); *F25J 1/0045* (2013.01); *F25J 1/0052* (2013.01); *F25J 1/0055* (2013.01); *F25J 1/0087* (2013.01); *F25J 1/0212* (2013.01); *F25J 1/0216* (2013.01); *F25J 1/0238* (2013.01); *F25J 1/0241* (2013.01); *F25J 1/0262* (2013.01); *F25J 3/0209* (2013.01); *F25J 2200/72* (2013.01); *F25J 2205/02* (2013.01); *F25J 2210/06* (2013.01); *F25J 2210/60* (2013.01); *F25J 2215/60* (2013.01);

(Continued)

(58) Field of Classification Search

CPC ..... F25J 3/0238; F25J 1/0022; F25J 3/0209; F25J 1/0045; F25J 2205/02; F25J 2200/72

See application file for complete search history.

(56) References Cited

U.S. PATENT DOCUMENTS

| | | | |
|---|---|---|---|
| 4,065,278 | A | 12/1977 | Newton et al. |
| 4,445,917 | A | 5/1984 | Chiu |

(Continued)

FOREIGN PATENT DOCUMENTS

| | | |
|---|---|---|
| CA | 1059425 | 7/1979 |
| DE | 102011109234 | 2/2013 |

(Continued)

OTHER PUBLICATIONS

T.J. Edwards, et al., "Analysis of Process Efficiency for Baseload LNG Production", Cryogenic Processes and Equipment Symposium, Jan. 1, 1984, 1-6.

*Primary Examiner* — Frantz F Jules
*Assistant Examiner* — Webeshet Mengesha
(74) *Attorney, Agent, or Firm* — Amy Carr-Trexler

(57) ABSTRACT

A system and method for integrated heavy hydrocarbon removal in a liquefaction system having a lean natural gas source. An economizer located between a main cryogenic heat exchanger and a reflux drum is provided to cool an overhead vapor stream against a partially condensed stream. In addition, pressure of the natural gas feed stream is maintained into a scrub column. A pressure drop is provided by a valve located between the economizer and the reflux drum on a partially condensed stream withdrawn from the cold end of the warm section of the main cryogenic heat exchanger.

12 Claims, 6 Drawing Sheets

(52) U.S. Cl.
CPC ..... *F25J 2220/64* (2013.01); *F25J 2230/60* (2013.01); *F25J 2235/02* (2013.01); *F25J 2240/40* (2013.01); *F25J 2245/02* (2013.01); *F25J 2270/02* (2013.01)

(56) References Cited

U.S. PATENT DOCUMENTS

| | | | | |
|---|---|---|---|---|
| 5,588,308 | A | 12/1996 | Daugherty | |
| 5,659,109 | A | 8/1997 | Fernandez de la Vega et al. | |
| 5,924,306 | A * | 7/1999 | Sinelnikov | F25J 3/0219 62/623 |
| 5,956,971 | A | 9/1999 | Cole et al. | |
| 6,662,589 | B1 | 12/2003 | Roberts et al. | |
| 10,539,363 | B2 * | 1/2020 | Jager | F25J 1/0219 |
| 2004/0200353 | A1 | 10/2004 | Bras et al. | |
| 2006/0260355 | A1 | 11/2006 | Roberts et al. | |
| 2007/0012071 | A1 | 1/2007 | Huang et al. | |
| 2008/0016910 | A1 * | 1/2008 | Brostow | F25J 1/0022 62/630 |
| 2008/0115532 | A1 | 5/2008 | Jager | |
| 2012/0090350 | A1 | 4/2012 | Mak | |
| 2013/0061632 | A1 | 3/2013 | Brostow et al. | |
| 2013/0098103 | A1 * | 4/2013 | Buijs | F25J 1/0212 62/611 |
| 2016/0327334 | A1 * | 11/2016 | Kikkawa | F25J 1/0262 |

FOREIGN PATENT DOCUMENTS

| | | |
|---|---|---|
| EP | 2650631 | 10/2013 |
| WO | 2015098125 | 7/2015 |

* cited by examiner

HEAVY HYDROCARBON REMOVAL SYSTEM FOR LEAN NATURAL GAS LIQUEFACTION

BACKGROUND

The present invention relates to a method of and system for separating heavy hydrocarbons from and liquefying a natural gas feed stream.

Removal of the heavy hydrocarbons (also referred to herein as "HHCs"), such as C6+ hydrocarbons (hydrocarbons having 6 or more carbon atoms) and aromatics (e.g. benzene, toluene, ethylbenzene and Xylenes), from natural gas prior to liquefaction of the natural gas is often desirable in order to avoid freeze-out of these components in the main cryogenic heat exchanger (also referred to herein as "MCHE"). C2-C5+ hydrocarbons (hydrocarbons having 2 to 5 or more carbon atoms), also referred to in the art as natural gas liquids (or "NGLs"), are typically also separated from natural gas because they have a relatively high market value.

Natural gas feeds are typically drawn from conventional natural gas reservoirs, as well as unconventional gas reservoirs, such as shale gas, tight gas and coal bed methane. A "rich" natural gas feed stream refers to a stream having a relatively a high concentration of NGL components (e.g. >3 mol %). Traditionally, removing HHCs from a rich natural gas feed involved either stand-alone front-end NGL extraction or a scrub column system integrated with the liquefaction process. Due to the fact that front-end NGL extraction is a relatively complicated process involving many pieces of equipment, it is usually conducted independently of the liquefaction process.

FIG. 1 depicts, schematically, a conventional prior art arrangement for a heavy hydrocarbon removal system 130 that uses a scrub column 136 and is integrated into a liquefaction process for a natural gas feed stream 102. The feed stream 102 is taken from a natural gas source 101, which typically has an ambient temperature in the range of 0-40 degrees C. The feed stream 102 is pre-cooled in an economizer 132 to a suitable temperature (typically below 0 degrees C.), then reduced in pressure through a JT valve 134 a pressure that is below the critical pressure of the natural gas in the feed stream 102. The critical pressure of the feed stream will vary, depending upon its composition. For example, methane has a critical pressure of 46.4 bara, while a lean natural gas feed stream that contains a low quantity of C2 to C5 components (e.g. less than 1 mol %) may have a critical pressure of about 50 bara. The higher the C2-C5 content, the higher the critical pressure.

The pre-cooled and pressure-reduced natural gas is then introduced into a scrub column 136 through an inlet 135 located at an intermediate location in the scrub column 136. The scrub column 136 separates the natural gas feed into a methane-rich overhead vapor stream 139 and a bottoms liquid stream 140, which is enriched in hydrocarbons heavier than methane. The overhead vapor stream 139 is withdrawn from a top section 137 of the scrub column 136 (which is above the inlet 135), and the bottoms liquid stream 140 is withdrawn from a bottom section 138 of the scrub column 136 (which is below the inlet 135). The top section 137 is also known in the art as the rectification section of a distillation column and the bottom section 138 is also known in the art as the stripping section of a distillation column. The boundary between the top section 137 and bottom section 138 is dependent on the location of the inlet 135. Each of the top and bottom sections 137, 138 can be filled with structured packing or constructed with trays for counter-current contact of liquid and vapor flows inside the scrub column 136. The scrub column 136 often is coupled with a dedicated reboiler 142 that heats a liquid stream 141 from the bottom of the column to provide stripping gas stream 143 to the bottom section 138 of the scrub column 136.

The overhead vapor stream 139 is then warmed in the cold side of the economizer 132 against the feed stream 102. The warmed overhead vapor stream 144 then flows into a warm end of a warm section (warm bundle) 114 of a coil-wound main cryogenic heat exchanger (MCHE) 110, in which the stream is partially condensed. The partially condensed stream 145 is then withdrawn from the warm section 114 and separated in a reflux drum 150 into its liquid and vapor phases to produce a liquid stream 154 and a vapor stream 151. The liquid stream 154 is pumped using a liquid pump 155 and returned to the top section 137 of the scrub column 136 as a reflux stream 156, which provides reflux necessary for efficient operation of the scrub column 136 and for washing down heavy hydrocarbons from the feed gas. The vapor stream 151 flows to a middle section 115 of the MCHE 110, where the vapor stream is further cooled and liquefied. The vapor stream is then sub-cooled in a cold section 116 of the MCHE 110, producing a product stream 103. The product stream 103 may be flashed through a pressure let-down valve 105 to produce a reduced-pressure product stream 106, which is then stored. Such storage is represented in FIG. 1 as an LNG storage tank 104.

The bottoms liquid stream 140 from the scrub column 136, which is rich in NGLs and HHCs, can be used as fuel or expanded to partially vaporize the stream, then sent to a fractionation process (not shown) where individual NGL components may be separated.

In this embodiment, the refrigeration used to convert the feed gas 102 to a liquefied product stream 103 is provided by a closed loop single mixed refrigerant (SMR) process 160. The term mixed refrigerant is also referred to a "MR" herein. As shown in FIG. 1, a warm MR stream 161 withdrawn from a warm end 111 of the MCHE 110 and is collected in a suction drum 162. A warm MR stream 163 then flows from the suction drum 162 to a low pressure MR compressor 164, where it is compressed to form an intermediate pressure MR stream 165. The intermediate pressure MR stream 165 is then cooled in an after-cooler 166 to form a cooled intermediate pressure MR stream 167, which is phase separated in a low pressure MR phase separator 168. A vapor stream 170 from the low pressure MR phase separator 168 is further compressed through a high pressure MR compressor 171 and the discharge stream 172 is cooled in an aftercooler 173. The cooled MR stream 174 is partially condensed and phase separated in a high pressure MR phase separator 175.

The low pressure mixed refrigerant liquid (or "LPMRL") stream 169 from the phase separator 168 is further cooled through the warm section 114 of the MCHE 110 in a refrigerant circuit 120*a*, removed as stream 121*b* at the cold end of the warm section 114, then flashed to low pressure through a JT valve 122*b* to provide a portion of the refrigeration required in the warm section 114 of the MCHE 110.

The high pressure mixed refrigerant vapor (or "HPMRV") stream 177 and the high pressure mixed refrigerant liquid (or "HPMRL") stream 176 from the warm high pressure MR separator 175 are also further cooled through the warm bundle 114 of the MCHE 110 through refrigerant circuits 118*a*, 119*a* respectively. The HPMRL stream 176 exits the cold end of the warm bundle 114 as stream 121*a* and is expanded across a JT valve 122*a* to provide a portion of the refrigeration required in the warm section 114 of the MCHE 110.

The HPMRV stream 177 exiting the warm section of the MCHE is partially condensed to stream 178 and phase separated in a cold MR separator 179. A cold mixed refrigerant liquid (or "CMRL") stream 181 from the cold MR separator 179 is subcooled through the middle section 115 of the MCHE 110 in a refrigerant circuit 119*b*. The subcooled CMRL stream exits the middle section 115 as stream 124 and is reduced in pressure across a JT valve 125. The resulting low pressure MR stream 126 enters the shell side of middle section 115 of the MCHE 110 to provide a portion of the refrigeration required in the middle section 115 of the MCHE 110. A cold mixed refrigerant vapor (or "CMRV") stream 180 from the cold MR separator 179 is liquefied and subcooled in the middle section 115 and the cold section 116 of the MCHE 110 through refrigerant circuits 118*b*, 188*c*. The subcooled MR stream 127 exits the cold section 116 and is reduced in pressure across a JT valve 128. The resulting low pressure MR stream 129 enters the shell side of the MCHE 110 at the cold end of the cold section 116 and is distributed over the cold section 116 to provide refrigeration to the cold section 116 of the MCHE 110. In this embodiment, the low pressure MR streams 123, 126 and 129 collectively provide all the refrigeration required in the MCHE 110. A low pressure MR stream 161 exiting the bottom of the MCHE 110 as superheated vapor is collected in the suction drum 162, thereby completing a close loop circulation.

In the case of removing HHCs from a natural gas stream, a scrub column can be effective in removing all the heavy hydrocarbon components from the stream. One drawback of the heavy hydrocarbon removal systems 130 the prior art, such as the system described above and shown in FIG. 1, is that the system must be operated at pressures lower than the critical pressure of the natural gas feed in order to achieve gas-liquid phase separation. This does not present a problem for a system having a rich natural gas feed, e.g. feed gas containing more than 4 mol % C2-C5 components, because the critical pressure of the feed gas may be higher than the pressure at which the feed gas is supplied. Therefore, the it is not necessary to lower the feed gas pressure prior to introducing it into the scrub column.

However, for a relatively lean feed gas, e.g. feed gas containing 2-4 mol % of C2-C5 components, removing HHC components using the conventional scrub column scheme becomes challenging and often requires a substantial reduction in feed gas pressure in order to operate the distillation column below the critical pressure of the feed gas. Conventionally, such reduction in feed gas pressure is taken at the inlet of the scrub column (e.g., valve 134 in FIG. 1). This pressure reduction often results in an operating pressure for the scrub column that reduces the efficiency of the natural gas liquefaction process.

In addition, stable operation of a scrub column requires sufficient liquid (i.e. reflux) to maintain a desired vapor flow ratio inside the column, which avoids column "dryout" and ensures proper separation efficiency. For a very lean feed gas, e.g. a feed gas containing less than 2 mol % of C2-C5 components, the amount of the reflux that can be generated is greatly reduced and column design and operation becomes very difficult and inefficient.

In the case of SMR process, as shown in FIG. 1, it should also be noted that the cold MR separator 179 and the reflux drum 150 both take streams from the cold end of the warm section 114 of the MCHE 110, and therefore, are operated at very similar temperature (e.g., within 5 degrees C. of each other). The temperature of the cold MR separator 179 also impacts the composition split between the CMRV stream 180 and the CMRL stream 181, while the operating temperature of the phase separator 50 impacts the amount of the reflux liquid in the reflux stream 156, and therefore, the effectiveness of the HHCs removal in the scrub column 136. The coupling between the operating temperatures of the cold MR separator 179 and the reflux drum 150 in a conventional scrub column system results in significant compromises between the effectiveness of HHC removal and mixed refrigerant cycle efficiency. For a lean feed gas, in order to provide enough reflux to effectively remove HHCs in the scrub column 136, the warm section 114 of the MCHE 110 may need to cool the feed gas (circuit 117*a*) to as cold as −70 degrees C. If a conventional scrub column configuration and SMR liquefaction process is used, the cold MR separator 179 must be operated at a similar temperature, which significantly reduces liquefaction efficiency. Other liquefaction process, such as dual mixed refrigerant (DMR) process and nitrogen expander process, may share the same "coupling" constraint as in SMR, i.e., the warm section outlet temperature impacts both HHC removal effectiveness and refrigerant cycle efficiency.

Finally, when there is a stripping section is provided in the scrub column 136, a dedicated reboiler 142 is used to heat the bottom liquid and provide stripping gas and duty to the bottom section 138 of the scrub column 136. A dedicated reboiler 142 requires heat from an outside heat source, such as heating oil or steam, to operate. Additional refrigeration then needs to be provided to the system needs to compensate for the heating duty, which can lead to lower liquefaction efficiency.

Based on the foregoing, there is a need for a liquefaction system for natural gas having an integrated system for removing heavy hydrocarbons that can process a lean natural gas feed stream without the significant reductions in liquefaction efficiency present in the prior art.

BRIEF SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Described embodiments, as described below and as defined by the claims which follow, comprise improvements to HHC removal methods and systems used as part of a lean natural gas liquefaction process. The disclosed embodiments satisfy the need in the art by allowing the feed gas to stay higher pressure (and hence better liquefaction efficiency) while still being able to provide enough reflux to scrub column and effectively remove HHCs.

Several specific aspects of the systems and methods of the present invention are outlined below.

Aspect 1: A method comprising:

(a) performing a closed-loop compression sequence on a warm first refrigerant stream withdrawn from a warm side of a main heat exchanger, the compression sequence comprising compressing and cooling the warm first refrigerant stream to produce at least one cooled, compressed first refrigerant stream;

(b) withdrawing a natural gas feed stream from a natural gas feed source at a source pressure;

(c) introducing the natural gas feed stream into a scrub column at a scrub column pressure, the scrub column having a top section and a bottom section;

(d) separating the natural gas feed stream in the scrub column into a methane-rich vapor fraction, collected as a first overhead vapor stream at a top end of the scrub column, and a heavy hydrocarbon-enriched fraction, collected as a first bottoms liquid stream at a bottom end of the scrub column;

(e) withdrawing the first bottoms liquid stream from the scrub column, the first bottoms liquid stream being a heavy hydrocarbon enriched natural gas stream;

(f) withdrawing the first overhead vapor stream from the scrub column, the first overhead vapor stream being a methane-enriched natural gas stream;

(g) introducing at a warm end of a warm section of a main heat exchanger, the first overhead vapor stream into a natural gas circuit, and each of the at least one cooled-compressed first refrigerant stream into a refrigerant circuit;

(h) in at least one of the refrigerant circuits, withdrawing and reducing a pressure of an overhead refrigerant stream to produce a reduced pressure overhead refrigerant stream and introducing the reduced pressure overhead refrigerant stream into a cold side of the main heat exchanger;

(i) providing indirect heat exchange between the warm side and the cold side of the main heat exchanger;

(j) producing a product stream from the natural gas circuit at a cold end of the main heat exchanger, the product stream being at least partially liquefied;

(k) withdrawing a partially condensed natural gas stream from the natural gas circuit at a cold end of the warm section of the main heat exchanger;

(l) reducing a pressure of the partially condensed natural gas stream to form a reduced pressure partially condensed natural gas stream;

(m) introducing the reduced pressure partially condensed natural gas stream into a reflux drum at an intermediate natural gas temperature;

(n) separating the reduced pressure partially condensed natural gas stream into a reflux drum liquid stream and a reflux drum vapor stream;

(o) introducing the reflux drum vapor stream into the natural gas circuit at a location in the main heat exchanger that is closer to a cold end of the main heat exchanger than the cold end of the warm section;

(p) increasing a pressure of the reflux drum liquid stream and introducing the reflux drum liquid stream into the top section of the scrub column; and (q) providing indirect heat exchange between the reflux drum vapor stream and the partially condensed natural gas stream by which the partially condensed natural gas stream is cooled against the reflux drum vapor stream.

Aspect 2: The method of Aspect 1, further comprising:

(r) operationally configuring any valves located between, and in flow communication with, the natural gas feed source and the scrub column to provide a total pressure drop of no more than one bar.

Aspect 3: The method of any one of Aspects 1-2, further comprising:

(s) withdrawing a partially condensed refrigerant stream from one of the at least one refrigerant circuits at a cold end of the warm section of the main heat exchanger and at an intermediate refrigerant temperature;

(t) separating the partially condensed refrigerant stream in a phase separator into an intermediate liquid refrigerant stream and an intermediate vapor refrigerant stream;

(u) introducing each of the intermediate liquid refrigerant stream and the intermediate vapor refrigerant stream into a refrigerant circuit at a location in the main heat exchanger that is closer to the cold end of the main heat exchanger that the cold end of the warm section.

Aspect 4: The method of any one of Aspects 1-3, wherein step (c) further comprises:

(i) providing indirect heat exchange between the warm side and the cold side of the main heat exchanger, the warm side of the main heat exchanger comprising at least one coil-wound bundle and the cold side of the main heat exchanger comprising a shell-side, each refrigerant circuit and the natural gas circuit comprising a portion of the at least one coil-wound bundle.

Aspect 5: The method of Aspect 4, wherein step (c) further comprises:

(c) separating the natural gas feed stream into a first portion and a second portion, introducing the first portion of the natural gas feed stream into the scrub column at an intermediate location and introducing the second portion of the natural gas feed stream into the bottom end of the scrub column.

Aspect 6: The method of any one of Aspects 4-5, further comprising:

(v) providing indirect heat exchange between the first overhead vapor stream and the first portion of the natural gas feed stream.

Aspect 7: The method of any one of Aspects 1-6, further comprising:

(w) pre-cooling the natural gas feed stream by indirect heat exchange against a second refrigerant before performing step (c).

Aspect 8: The method of any one of Aspects 1-7, further comprising:

(x) withdrawing a condensed natural gas stream from the natural gas circuit from a cold end of a middle section of the main heat exchanger, increasing the pressure of the condensed natural gas stream to form an increased pressure natural gas stream, and introducing the increased pressure natural gas stream into the reflux drum.

Aspect 9: The method of any one of Aspects 1-8, wherein step (p) comprises:

(p) increasing a pressure of the reflux drum liquid stream, splitting the reflux drum liquid stream into a first portion and second portion, introducing the first portion of the reflux drum liquid stream into the top section of the scrub column, and mixing the second portion of the reflux drum liquid stream with the reflux drum vapor stream before performing step (o).

Aspect 10: The method of any one of Aspects 1-9, further comprising (y) Performing an indirect heat exchange between the partially condensed natural gas stream and a third refrigerant before performing step (l).

Aspect 11: The method of any one of Aspects 1-10, wherein step (h) further comprises splitting at least one of the reduced pressure overhead refrigerant streams into a first portion and a second portion, introducing the first portion into the cold side of the main heat exchanger, performing an indirect heat exchange between the second portion, the reflux drum vapor stream and the partially condensed natural gas stream.

Aspect 12: The method of any one of Aspects 1-11, further comprising:

(z) Increasing a pressure of the natural gas feed stream using a compressor before performing step (c).

Aspect 13: A system for liquefying a natural gas feed stream, the system comprising:

a natural gas feed connected to a source of natural gas;

a refrigerant compression system operationally configured to compresses and cool a warm first refrigerant stream to produce a high pressure vapor first refrigerant stream and a high pressure first refrigerant liquid stream, the refrigerant compression system comprising at least one compressor, at least one after cooler, and at least one phase separator;

a main heat exchanger comprising a warm end, a cold end, a warm section, a cold section, a warm side, a cold side, a first refrigerant circuit located on the warm side, a second refrigerant circuit located on the warm side, a natural gas circuit located on the warm side and having an intermediate outlet at a warm end of the natural gas circuit, wherein the first refrigerant circuit is in fluid communication with the high pressure vapor first refrigerant stream at the warm end of the main heat exchanger and the second refrigerant circuit is in fluid communication with the high pressure first refrigerant liquid stream at the warm end of the main heat exchanger, the main heat exchanger being operationally configured to provide indirect heat exchange between the warm side and the cold side of the main heat exchanger;

a scrub column comprising an a feed stream inlet in flow communication with the natural gas feed stream and an outer shell that defines an internal volume comprising a top section located above the feed stream inlet and a bottom section located below the feed stream inlet, the scrub column having a vapor outlet located in the top section of the scrub column, a liquid outlet located in the bottom section of the scrub column, a liquid inlet located in the top section of the scrub column, the vapor outlet of the scrub column being in fluid communication with the natural gas circuit at the warm end of the main heat exchanger;

a reflux drum having an inlet in fluid communication with the intermediate outlet of the main heat exchanger, a vapor outlet in fluid communication with an intermediate inlet of the main heat exchanger, and a liquid outlet that is in fluid communication with the liquid inlet of the scrub column;

a pump located between, and in fluid communication with, the liquid outlet of the reflux drum and the liquid inlet of the scrub column; and a first economizer having a warm conduit and a cold conduit operationally configured to provide indirect heat exchange between the warm conduit and the cold conduit, the warm conduit located between, and in fluid communication with, the intermediate outlet of the main heat exchanger and the inlet of the reflux drum, the cold conduit being located between, and in fluid communication with, the vapor outlet of the reflux drum and the intermediate inlet of the main heat exchanger.

Aspect 14: The system of Aspect 13, wherein the main heat exchanger comprises a coil-wound heat exchanger having a warm bundle and a cold bundle, wherein the intermediate outlet of the natural gas circuit is located at a cold end of the warm bundle.

Aspect 15: The system of any one of Aspects 13-14, wherein the at least one phase separator of the refrigerant compression system comprises a cold refrigerant phase separator having a phase separator inlet in fluid communication with a cold end of the first refrigerant circuit, a bottoms liquid refrigerant stream that is withdrawn from a bottom end of the cold refrigerant phase separator, and an overhead vapor refrigerant stream withdrawn from a top end of the cold refrigerant phase separator, the overhead vapor refrigerant stream and the bottoms liquid refrigerant stream both being in fluid communication with the warm side of the main heat exchanger at a location closer to the cold end of the main heat exchanger than the cold end of the first refrigerant circuit.

Aspect 16: The system of any one of Aspects 13-15, wherein the first refrigerant comprises a mixed refrigerant.

Aspect 17: The system of any one of Aspects 13-15, wherein the scrub column further comprises a vapor inlet.

Aspect 18: The system of any one of Aspects 13-17, further comprising a precooler that is positioned and operationally configured to cool the natural gas feed stream upstream from the feed stream inlet to a temperature below zero degrees C.

Aspect 19: The system of any one of Aspects 13-18, further comprising a first pressure-reducing valve located between, and in fluid communication with the, the warm conduit of the first economizer and the inlet of the reflux drum.

Aspect 20: The system of any one of Aspects 13-19, further comprising a heat exchanger located between the first economizer and the reflux drum and in fluid communication with the warm conduit of the first economizer.

DETAILED DESCRIPTION

Figure 1:
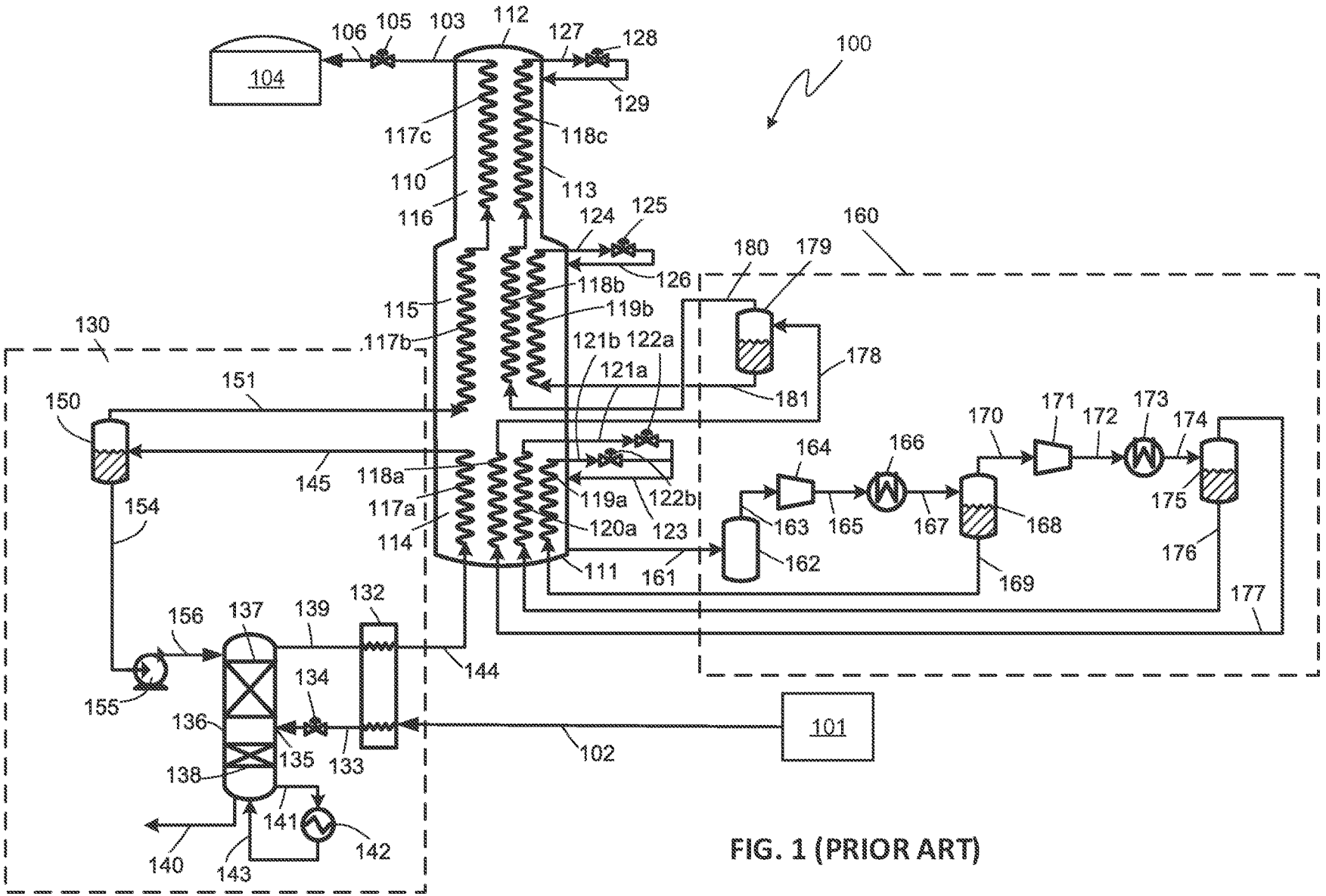
FIG. 1 (PRIOR ART)
FIG. 1 is a schematic flow diagram depicting a HHC removal and an SMR natural gas liquefaction system and method in accordance with the prior art.

This present invention provides novel ways of achieving the temperature and pressure of the natural gas feed stream at the scrub column reflux drum for effectively providing reflux and condensing duty to the scrub column in integration with the natural gas liquefaction process.

As described above, when the natural gas feed stream has a composition that is low ("lean") in C2-C5 components and contains sufficient levels of heavy hydrocarbons, the conventional scrub column configuration is ineffective or energy inefficient. The inventors have found that the HHC removal effectiveness and the liquefaction efficiency can be improved by introducing an economizer heat exchanger between the MCHE and the reflux drum and changing the way in pressure of the feed gas is handled in the heavy hydrocarbon removal process.

More specifically, the separation effectiveness and energy efficiency of the overall process can be improved by allowing the reflux drum to operate at a temperature significantly different than the feed gas temperature exiting the warm section of the MCHE. This decoupling of the reflux operating temperature from the rest of the refrigerant cycle provides an additional degree of freedom, which allows for better overall process optimization. The economizer warms the overhead vapor from the reflux drum to a temperature that is only few degrees colder than the MCHE warm section outlet temperature, which helps reduces the temperature differential at the warm end of the middle section of the MCHE and improves process thermal efficiency. The temperature difference depends upon the design temperature approach of the economizer, but is typically less than 5 degrees C. and is often less than 2 or 3 degrees C.

In addition, a pressure let-down valve is placed between the MCHE and the reflux drum. This has two benefits over the conventional scrub column configurations. First, with the majority pressure drop taken at this let-down valve, very little (or no) pressure drop needs to be provided at the inlet of the scrub column itself, thereby maintaining higher feed gas density and lower feed volumetric flow in the warm section of the MCHE. This reduces the required size of the MCHE and associated capital cost. Secondly, taking the pressure drop at this location achieves cooling to the feed gas itself, off-loading a portion of the condensing duty required from the warm section of the MCHE and benefiting the HHC removal effectiveness and the overall liquefaction efficiency. Providing the pressure let-down valve in this location also helps maintains proper approach temperature in the economizer between the MCHE and the reflux drum.

Moreover, additional reflux can be provided using fully condensed LNG streams taken anywhere from the system, including but not limited to LNG stream from the middle section outlet, subcooled LNG stream from cold section outlet, and LNG production pumped from the LNG storage tank.

Optionally, supplemental refrigeration and condensing duty can be provided by using an additional cooler or adding an additional cooling circuit in the economizer. Cooling medium can be taken from any stream in the system that is colder than the feed gas temperature at the MCHE warm section outlet.

Finally, and as noted above, a portion of the feed gas stream is directly used as a stripping gas to the scrub column. This avoids the use of extra heating source and more importantly helps maintain a proper liquid to vapor flow ratio in the column. It helps achieve better overall liquefaction efficiency and maintain column operability and improves HHC removal effectiveness.

The articles "a" and "an", as used herein and unless otherwise indicated, mean one or more when applied to any feature in embodiments of the present invention described in the specification and claims. The use of "a" and "an" does not limit the meaning to a single feature unless such a limit is specifically stated. The article "the" preceding singular or plural nouns or noun phrases denotes a particular specified feature or particular specified features and may have a singular or plural connotation depending upon the context in which it is used.

The terms "fluid communication" and "fluid flow communication" as used in the specification and claims, both refer to the nature of connectivity between two or more components that enables liquids, vapors, and/or two-phase mixtures to be transported between the components in a controlled fashion (i.e., without leakage) either directly or indirectly. Coupling two or more components such that they are in fluid flow communication with each other can involve any suitable method known in the art, such as with the use of welds, flanged conduits, gaskets, and bolts. Two or more components may also be coupled together via other components of the system that may separate them, for example, valves, gates, or other devices that may selectively restrict or direct fluid flow.

The term "conduit," as used in the specification and claims, refers to one or more structures through which fluids can be transported between two or more components of a system. For example, conduits can include pipes, ducts, passageways, and combinations thereof that transport liquids, vapors, and/or gases.

The term "natural gas", as used in the specification and claims, means a hydrocarbon gas mixture consisting primarily of methane.

The term "mixed refrigerant" (also abbreviated as "MR"), as used in the specification and claims, means a fluid comprising at least two hydrocarbons and for which hydrocarbons comprise at least 80% of the overall composition of the refrigerant.

The terms "heavy component" or "heavy hydrocarbon", as used in the specification and claims, means a hydrocarbon that has a boiling point higher than methane at standard pressure.

As used herein, the term "indirect heat exchange" refers to heat exchange between two fluids where the two fluids are kept separate from each other by some form of physical barrier.

As used herein, the term "warm stream" is intended to mean a fluid stream that is cooled by indirect heat exchange under normal operating conditions of the system being described. Similarly, the term "cold stream" is intended to mean a fluid stream that is warmed by indirect heat exchange under normal operating conditions of the system being described.

As used therein, the term "warm side" is intended to mean a portion of a heat exchanger through with one or more warm streams flow. Similarly, the term "cold side" is intended to mean a portion of the heat exchanger through which one or more cold streams flow.

The term "scrub column" refers to a type of distillation column, which is a column containing one or more separation stages, composed of devices such as packing or trays, that increase contact and thus enhance mass transfer between upward rising vapor and downward flowing liquid flowing inside the column. In this way, the concentration of lighter (i.e. higher volatility and lower boiling point) components increases in the rising vapor that collects as overhead vapor at the top of the column, and the concentration of heavier (i.e. lower volatility and higher boiling point) components increases in the descending liquid that collects as bottoms liquid at the bottom of the column. The "top" of the distillation column refers to the part of the column at or above the top-most separation stage. The "bottom" of the column refers to the part of the column at or below the bottom-most separation stage. An "intermediate location" of the column refers to a location between the top and bottom of the column, between two separation stages.

In the case of a scrub column, the natural gas feed stream is introduced (as a gaseous stream or as a partially condensed, two-phase stream) into the scrub column at an intermediate location of the column or, more typically, at the bottom of the column. The upward rising vapor from the feed stream is then brought into contact, as it passes through one or more separation stages inside the scrub column, with a downward flowing liquid reflux stream, thereby "scrubbing" components heavier than methane from said vapor (i.e. removing at least some of said less volatile components from the vapor). This results, as noted above, in the natural gas feed stream being separated into a methane-rich vapor fraction collected as an overhead vapor (referred to herein as a "first overhead vapor") at the top of the scrub column, and a liquid fraction, enriched in hydrocarbons heavier than methane, collected as a bottoms liquid (referred to herein as a "first bottoms liquid") at the bottom of the scrub column.

As used herein, the term "separator" or "phase separator" refers to a device, such as drum or other form of vessel, in which a two phase stream can be introduced in order to separate the stream into its constituent vapor and liquid phases. A reflux drum is a type of phase separator that is operationally configured to provide liquid reflux for a distillation column.

Solely by way of example, certain exemplary embodiments of the invention will now be described with reference to FIGS. 2 to 6. In the figures, elements that are similar to those of a previous embodiment are represented by reference numerals increased by a multiple of 100. For example, the main cryogenic heat exchanger 110 of FIG. 1 has the same structure and function as the main cryogenic heat exchanger 210 of FIG. 1. Such elements should be regarded as having the same function and structure unless otherwise stated or depicted herein, and the discussion of such elements may therefore not be repeated for multiple embodiments.

In the embodiments depicted in FIGS. 2 to 6, the main cryogenic heat exchanger, used to liquefy the natural gas, is shown as being a coil-wound heat exchanger. Although use of a coil wound heat exchanger is currently the preferred technology, the main exchanger could alternatively be a plate and fin heat exchanger, or another type of heat exchanger known in the art or developed in the future. Similarly, although in the embodiments depicted herein depict the coil bundles of the main heat exchanger as being housed in a single shell, thereby forming a single unit, the main heat exchanger could comprise a series of two or more units, with having its own casing/shell, or with one or more of the bundles being housed in one casing/shell, and with one or more other bundles being housed in one or more different casings/shells. The refrigerant cycle used to supply cold refrigerant to the main heat exchanger may likewise be of any type suitable for carrying out the liquefaction of natural gas. Exemplary cycles known and used in the art, and that could be employed in the present invention, include single mixed refrigerant cycle (SMR), the propane pre-cooled mixed refrigeration cycle (C3MR), nitrogen expander cycle, methane expander cycle, dual mixed refrigerant cycle (DMR), and cascade cycle.

Figure 2:
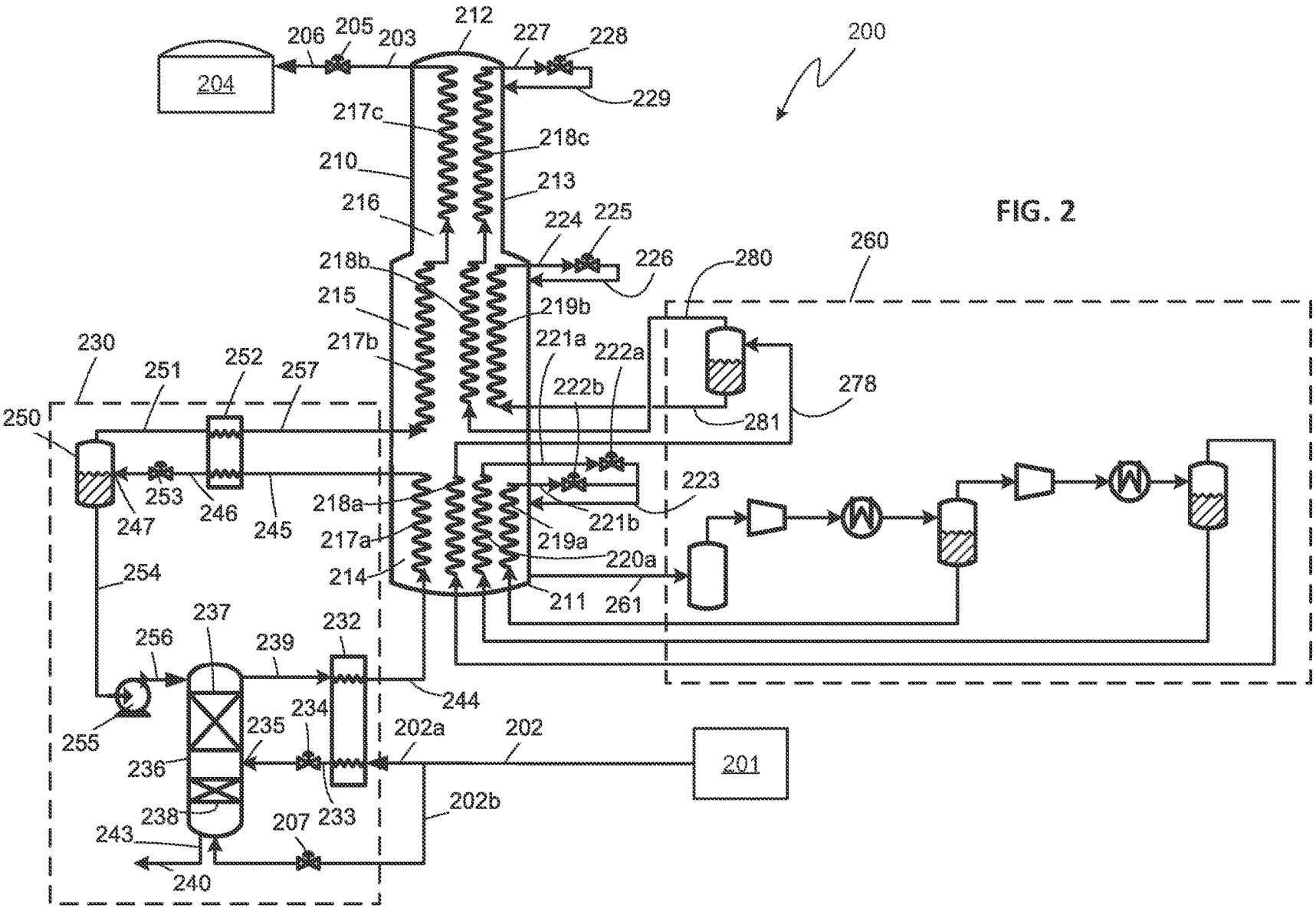
FIG. 2 is a schematic flow diagram depicting a HHC removal and an SMR natural gas liquefaction system and method in accordance with a first exemplary embodiment of the present invention.

Referring now to FIG. 2, in this embodiment, the natural gas feed stream 202 is separated in a first portion 202*a* and a second portion 202*b* before being introduced into the scrub column 236. The first portion 202*a* is pre-cooled in an economizer 232 to a suitable temperature, preferably below 0 degrees C., and more preferably between −10 degrees C. and −40 degrees C. The cooled first portion is then introduced into the scrub column 236 through the feed stream inlet 235, where it is separated into a methane-rich overhead vapor stream 239 and a bottom liquid stream 240, which is enriched in hydrocarbons heavier than methane. Preferably there is zero or very low pressure drop (e.g. less than one bar) across the inlet valve 234 such that the feed gas entering the scrub column 236 at the inlet 235 is slightly below the original pressure of the feed gas stream 202. For example, if the feed gas stream 202 enters the inlet valve 234 at 65 bara, the outlet pressure from the inlet valve 234 is nominally 64 bara (not including any pressure drops due to connecting conduits and the economizer 232 passages). The second portion 202*b* is used as stripping gas to the bottom section 238 of the scrub column 236. The flow rate of the second portion 202*b* is regulated by an inlet valve 207 that is preferably configured and operated to provide a pressure drop of less than one bar.

The overhead vapor stream 239, is withdrawn from the top section 237 of the scrub column 236 and the bottom liquid stream 240 is withdrawn from the bottom section 238 of the scrub column 236. The top section 237 is also known in the art as the rectification section of a distillation column while the bottom section 238 is also known in the art as the stripping section of a distillation column. The boundary of the two sections is dependent on the location of the feed stream inlet 235. The two sections can be filled with structured packing or contrasted with trays for counter-current contact of liquid and vapor flows inside the scrub column 236.

The overhead vapor stream 239 is warmed by the economizer 232, which provides indirect heat exchange against the feed gas stream 202. The warmed overhead vapor stream 244 then flows into the warm section (warm bundle) 214 of a MCHE 210, in which it is cooled to a temperature typically between −40 degrees C. and −60 degrees C., and typically also partially condensed. The partially condensed natural gas stream 245 is then withdrawn from the warm section 214 of the MCHE 210 and is further cooled in an economizer 252 against the overhead vapor stream 251 from the reflux drum 250. The cooled feed gas stream 246 exiting the economizer 252 is expanded across a pressure let-down JT valve 253 to a lower pressure such that sufficient liquid is formed in the reflux drum. Depending on the feed gas composition, the reflux drum is often operated at 2-10 bar below the critical pressure of the feed. The sub-critical pressure feed stream is then introduced into the reflux drum 250 at inlet 247, where it is phase separated to form the bottoms liquid stream 254 and the overhead vapor stream 251.

The operating pressure and temperature of the reflux drum 250 (which is the same as the outlet pressure and temperature of the JT valve 253) is such that the density ratio of the liquid phase to the vapor phase in the reflux drum 250 is higher than 1 and, preferably, higher than 4. In addition, the surface tension of the liquid phase in the reflux drum 250 is high enough to have a clear phase boundary, preferably higher than 2 dyne/cm. The bottoms liquid stream 254 from the reflux drum 250 is then pumped, using a liquid pump 255, and returned to the top end of the scrub column 236 as a reflux stream 256 in order to provide the necessary reflux for operation of the scrub column and washing down heavy hydrocarbons from the feed gas. As noted above, the overhead vapor stream 251 is warm in the economizer 252 against the partially condensed natural gas stream 245 exiting the warm section 214 of the MCHE 210 and before being sent to the middle section 215 of the MCHE 210.

The components and operation of the refrigerant compression system 260 is essentially the same as the refrigerant compression system 160 described in connection with FIG.

1. Accordingly, reference numerals are not provided in FIG. 2 for the elements of the refrigerant compression system 260.

In comparison to the conventional arrangement shown in FIG. 1, the method and system of the embodiment of the present invention depicted in FIG. 2 therefore differs in the manner in which the majority of the feed pressure let-down is taken at the inlet 247 of the reflux drum 250 and the reflux drum 250 operating temperature is significantly lower (e.g. 5-30 degrees C. lower) than the temperature of the streams 245, 278, 221*a*, 221*b* exiting the warm end of the warm section 214 of the MCHE 210. As a result, the feed gas stream is maintained at higher pressure in the natural gas circuit 217*a* through the warm section 214 of the MCHE 210 than in the natural gas circuit 117*a* of FIG. 1. Moreover, in the embodiment of FIG. 2, the operating temperature of the cold MR separator 279 is much warmer (5-30 degrees C., preferably at least 5 degrees C. and, more preferably, at least 10 degrees C.) than the temperature in the reflux drum 250. By decoupling the operating temperatures of the cold MR separate 279 and the reflux drum 250 allows for more freedom to independently optimize the refrigeration loop and the heavy hydrocarbon removal system 230. In addition, the economizer 252 also helps maintain a tighter temperature differential at the warm end the middle section (bundle) 215, meaning that streams 257, 280, 281 have a smaller temperature differential as they enter the warm end of the middle section 215 than streams 157, 180, 181 of FIG. 1. Finally, replacing or supplementing the dedicated reboiler 142 in FIG. 1 with a stripping gas (second portion 202*b* of the feed gas stream 202) reduces or avoids the need for an external heat input to the system. All of the above allows the overall liquefaction efficiency to improve significantly, as demonstrated in the Example provided herein.

Figure 3:
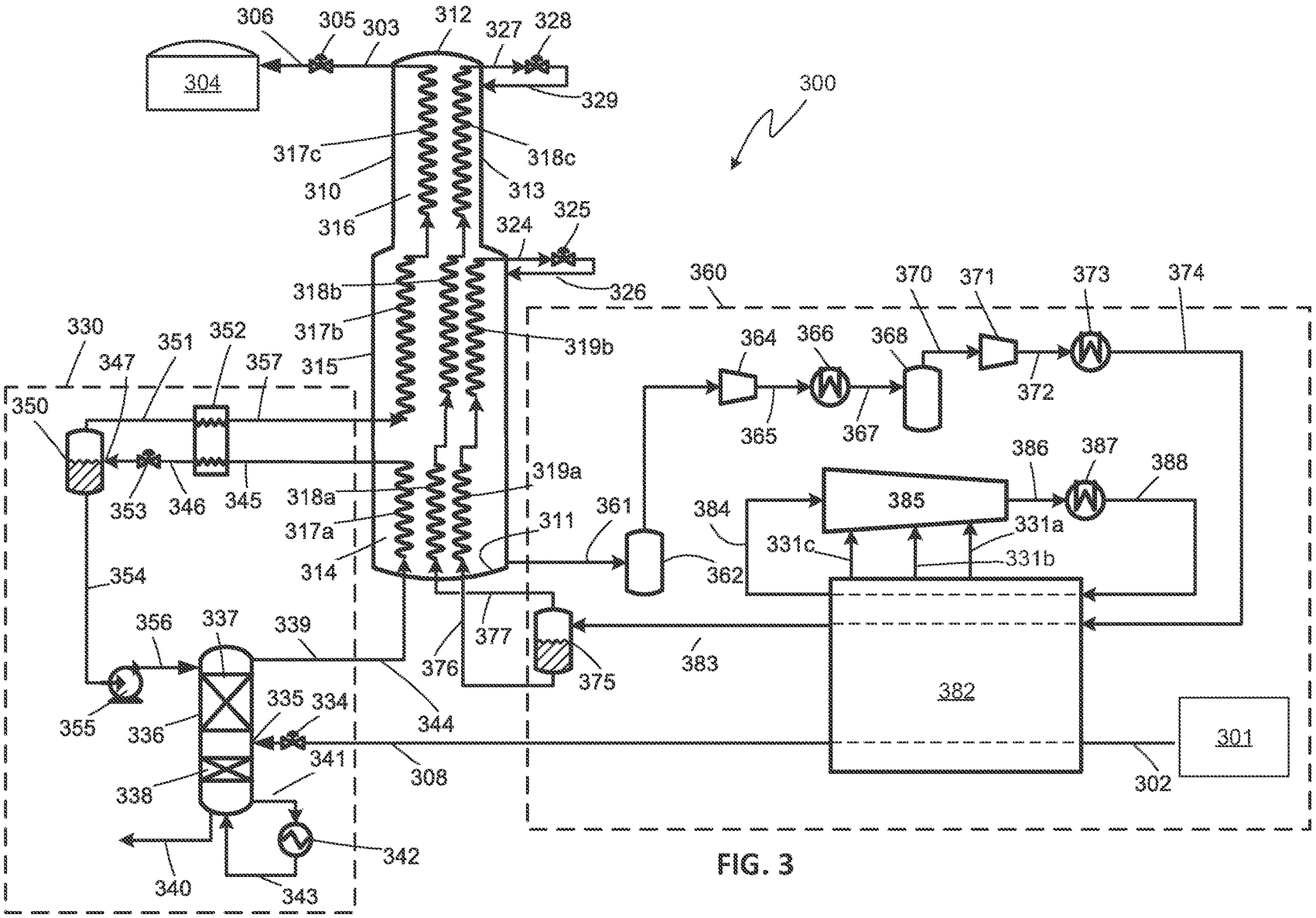
FIG. 3 is a schematic flow diagram depicting HHC removal and a propane-mixed refrigerant (or "C3MR") natural gas liquefaction system and method in accordance with a second exemplary embodiment of the present invention.

Similar improvement to the process can be achieved with other refrigerant cycles, such as propane precooled mixed refrigerant process (C3-MR). Referring now to FIG. 3, another exemplary embodiment of the invention is depicted, in which refrigerant duty is provided by a propane refrigerant cycle and a mixed refrigerant cycle. The propane refrigerant cycle pre-cools both the feed gas and the mixed refrigerant.

In this embodiment, the feed gas stream 302 cooled in one or more propane kettles (collectively represented by block 382 and also referred to as a precooler) to a temperature preferably below zero degrees C. and, more preferably, to between −20 degrees C. and −35 degrees C. before being sent to the scrub column 336. Low pressure propane refrigerant streams 384, 331*c*, 331*b*, 331*a* (collected from the a series of evaporator kettles operated at different pressures and temperatures) are compressed in the propane compressor 385 to form a high pressure discharge propane stream 386. The high pressure discharge propane stream 386 is then cooled and fully condensed in one or more aftercooler 387 to form and high pressure liquid propane refrigerant stream 388. The high pressure liquid propane refrigerant stream 388 is then evaporated at multiple pressure to provide sequential cooling to the feed gas stream 302 and the high pressure mixed refrigerant stream 374. The warm low pressure mixed refrigerant 361 from the MCHE 310 is compressed by a series of compressors 364, 371, and cooled by a series of after coolers 366, 373, to form a high pressure mixed refrigerant stream 374. After being cooled and partially condensed through the series of propane kettles 382, the cooled high pressure mixed refrigerant stream 383 is phase separated in a phase separator 375 into a mixed refrigerant liquid (MRL) stream 376 and a mixed refrigerant vapor (MRV) stream 377. The MRL stream 376 is further subcooled in the warm 314 and middle sections 315 of the MCHE 310 before being expanded through a JT valve 325 to form a low pressure cold refrigerant stream 326. The low pressure cold refrigerant stream 326 is then sent to the shell side of the middle section 315 of the MCHE 310 to provide refrigeration to the system. The MRV stream 377 is further cooled, condensed and subcooled sequentially in the warm, middle and cold sections of the MCHE 310 before being expanded through a JT valve 328 to form another low pressure cold refrigerant stream 329. The low pressure cold refrigerant stream 329 is then sent to the shell side of the cold section 316 of the MCHE 310 to provided refrigeration to the system.

The system 300 shown in FIG. 3 differs from system 200 in that the first economizer (economizer 232 in system 200) is not needed because the feed gas stream 202 has already been precooled in the propane kettles 382. It also differs in that there is no cold MR separator between the middle 315 and the warm sections 314 of the MCHE 310 in system 300. However, as in system 200, the feed gas stream 345 exiting the warm section 314 of the MCHE 310 is further cooled in an economizer 352, located between the MCHE 310 and the reflux drum 350. The feed gas stream 346 exiting the economizer 352 is expanded across a pressure let-down JT valve 353 to a pressure that is blow its critical pressure. It is then phase separated in the reflux drum 350 into its liquid and vapor phases to produce a liquid stream 354 and an overhead vapor stream 351. The operating pressure and temperature of the reflux drum 350 (same as the outlet pressure and temperature of the JT valve 353) is such that the density ratio of the liquid phase to the vapor phase in the drum is higher than 1 and, preferably, higher than 4. The surface tension of the liquid phase in the reflux drum 250 is high enough to have a clear phase boundary—preferably 2 dyne/cm.

Comparing system 300 to the system 100 of the prior art from the perspective of operation of the heavy hydrocarbon removal systems 330, 130, the majority of the pressure drop in the feed gas occurs just before the inlet 347 of the reflux drum 350. This allows the reflux drum 350 operating temperature to be much colder than the temperature of the feed gas stream 345 exiting the warm section 314 of the MCHE 310 and the pressure of the feed gas can be maintained relatively high (e.g. 1-10 bara higher than the same stream in FIG. 1.) in the warm 314 and middle sections 315 of the MCHE 310 as compared to system 100 (the prior art). All of the above helps achieve better overall liquefaction.

Such arrangement for C3-MR process also allows more flexible operation as composition of the feed gas stream 302 changes. For example, as the composition of the feed gas stream 302 becomes leaner, system 300 allows the removal of HHC to be achieved efficiently by taking more pressure drop at the JT valve 353, while keeping operational parameters of the refrigerant compression system 360 and the scrub column 336 relatively constant.

Figure 4:
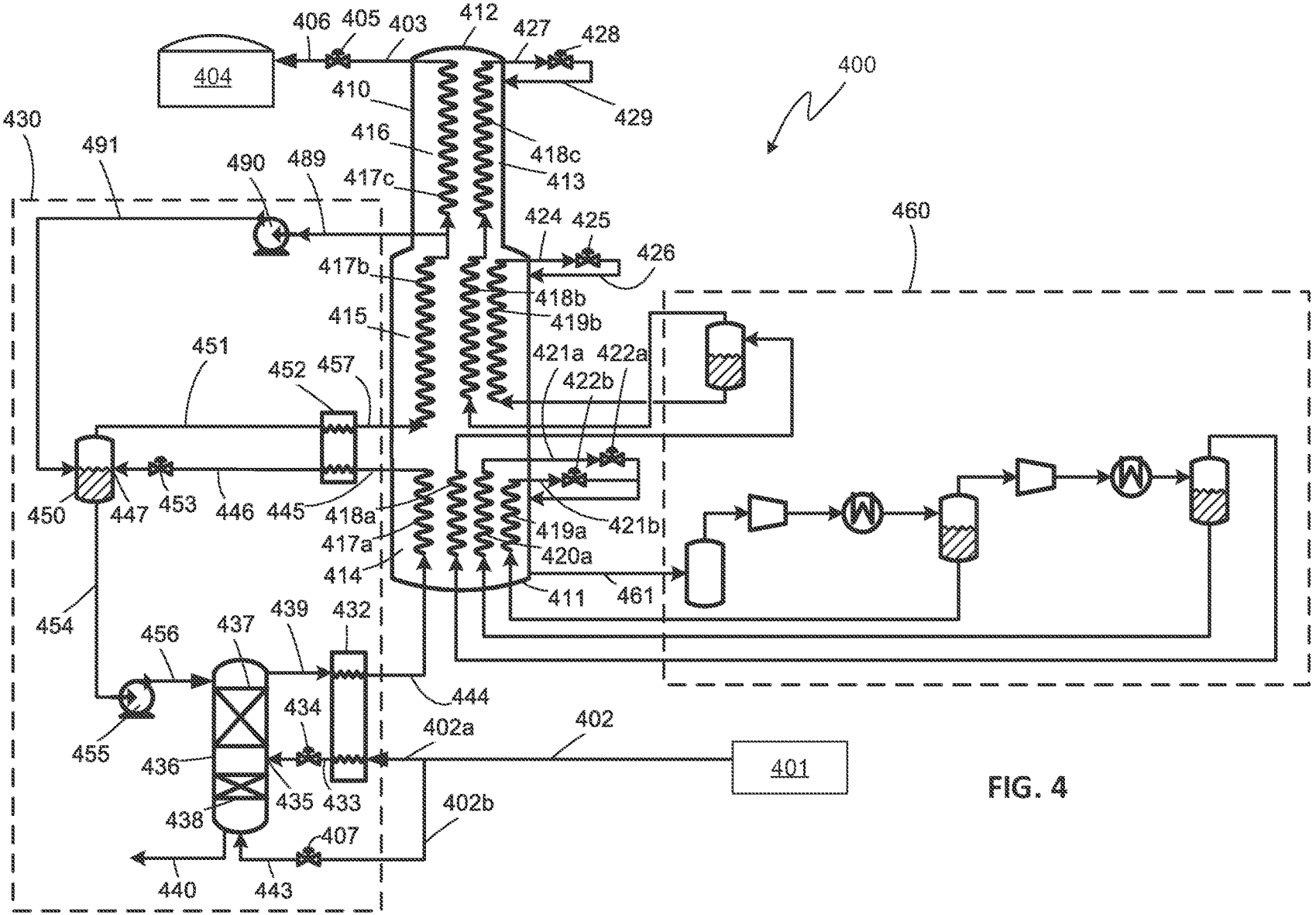
FIG. 4 is a schematic flow diagram depicting HHC removal and an SMR natural gas liquefaction system and method in accordance with a third exemplary embodiment of the present invention.

Referring now to FIG. 4, in system 400 an additional reflux stream 489 is provided using a portion of the fully liquefied LNG stream exiting the feed gas circuit 117*b* at the cold end of the middle section 415 of the MCHE 410. The pressure of the additional reflux stream 489 is increased by a pump 490 and the increased pressure reflux stream 491 flows into the reflux drum 450, where it is mixed with the overhead vapor stream 451 coming from the cold end of the warm section 414 of the MCHE 410. This additional reflux helps supplement the reflux flow and duty. It also helps maintain the reflux drum at a temperature much colder (e.g.

5-30 degrees C.) than the overhead vapor stream 451 coming from the cold end of the warm section 414 of the MCHE 410, especially when the feed gas source 401 is at a lower pressure (e.g. 30-45 45 bara, or a pressure that is already below the feed gas critical pressure) and self-cooling through the pressure let-down valve 453 is not sufficient to achieve the desired temperature.

It should be noted that such additional reflux could be provided using one or more fully condensed LNG streams taken anywhere from the system 400, including but not limited to an LNG stream from the cold end of the middle section 415, the subcooled LNG stream 403, the LNG product stream 406, or even final LNG product pumped from the LNG storage tank 404.

Figure 5:
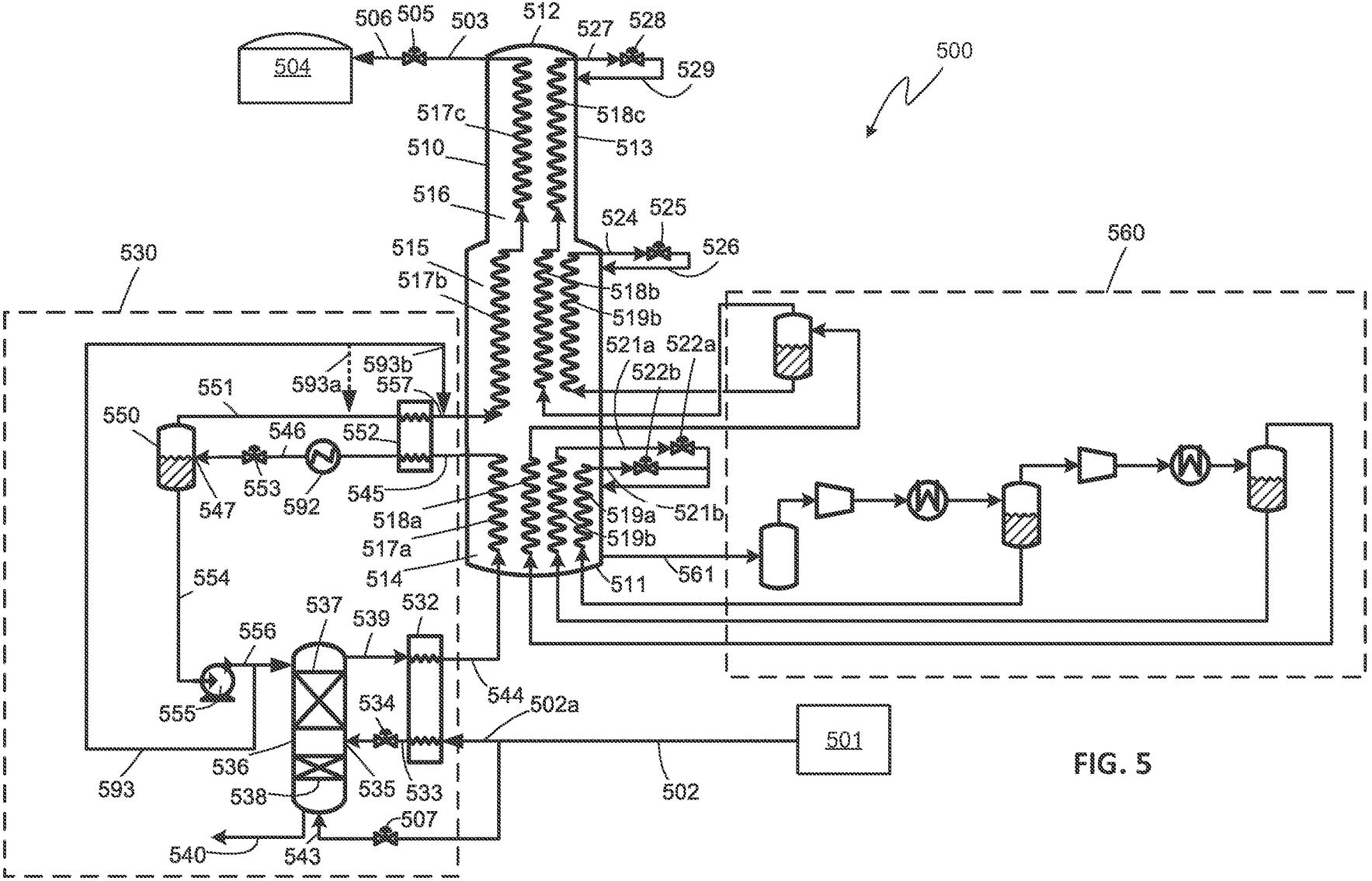
FIG. 5 is a schematic flow diagram depicting HHC removal and natural gas liquefaction system and method in accordance with a fourth exemplary embodiment of the present invention.

In yet another embodiment, as depicted in FIG. 5, system 500 includes supplemental refrigeration and condensing duty provided by using an additional cooler 592 located between the economizer 552 and the pressure let-down valve 553. Cooling medium for the cooler 592 can be sourced from any stream in the system 500 that is colder than the temperature of the partially condensed stream 545. For example (not shown), a portion of the CMRL stream 524 could be expanded and directed to the cooler 592 to help cool the partially condensed stream 545. A spent CMRL slip stream from the cooler 592 is sent back to the shell side of the MCHE 510, preferably at an intermediate location between the warm 514 and the middle sections 515 of the MCHE 510. This arrangement helps maintaining the reflux drum 550 at a temperature much colder (e.g. 5-30 degrees C. colder) than the overhead vapor stream 545, especially when the feed gas source 501 is at lower pressure and self-cooling through the JT valve 553 is not sufficient to achieve the desired temperature.

System 500 also includes a reflux pump-forward option. With this option, a portion of the pumped reflux liquid stream 556 is directed to and mixed with the overhead vapor stream 551 instead of being sent to the top section 537 of the scrub column 536. The mixing point can either be before the economizer 552 (as indicated by stream 593*a*) or after the economizer 552 (as indicated by stream 593*b*). This option provides additional operational flexibility. For example, as the feed gas stream 502 become richer, more liquid will be formed in the reflux drum 550. If no other operational change is desired, the amount of pump-forward liquid can be increased, and vice versa.

Figure 6:
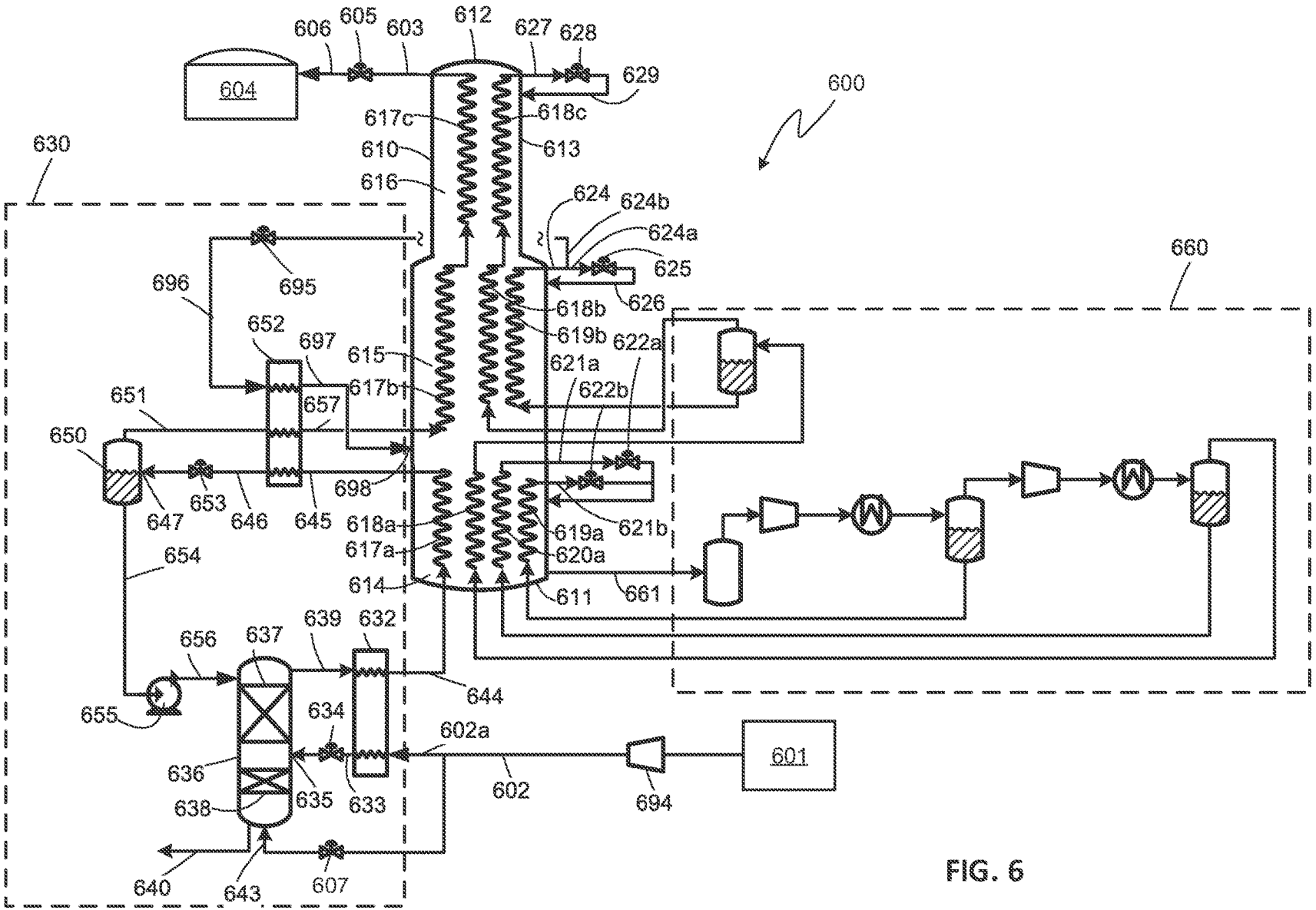
FIG. 6 is a schematic flow diagram depicting HHC removal and natural gas liquefaction system and method in accordance with a fifth exemplary embodiment of the present invention.

Referring to FIG. 6, another exemplary embodiment is shown as system 600. In system 600, an additional cooling circuit is added to the economizer 652. A portion of the CMRL stream 624 is expanded and directed to the economizer 652 to help cool the overhead vapor stream 645. A spent CMRL slip stream 697 from the economizer 652 is sent back to the shell side of the MCHE 610, preferably an intermediate location 698 between the warm 614 and the middle sections 615 of the MCHE 610. Similar to system 500, this arrangement also helps maintaining the reflux drum 650 at a temperature much colder than the overhead vapor stream 645 as it exits the warm section 614 of the MCHE 610. Optionally, a feed booster compressor 694 could be added to increase the pressure of the feed gas stream 602, allowing higher self-cooling capability at the pressure let-down valve 653 at the inlet 647 of the reflux drum 650.

EXAMPLE

Table 1 below shows a comparison between a set of simulated operating conditions of various streams of system 100 (FIG. 1) and system 200 (FIG. 2). The data in this table illustrates that using economizer between the MCHE 210 and the reflux drum 250 and introduce pressure drop at the inlet 247 of the reflux drum 250 can significantly improve the overall liquefaction efficiency. The liquefaction efficiency is typically measured by specific power, which is calculated by dividing the total refrigeration power by the production rate. However specific power means higher liquefaction efficiency. The feed pressure is maintained higher than that in the prior art in both the warm and middle sections of the MCHE. Specifically, as can be seen from the table, the feed gas through warm section of the system 200 is about 10 bara higher than that in system 100; while the feed gas through middle section of the system 200 is about 3 bara higher than that in system 100. Maintaining higher feed gas pressure helps achieve higher liquefaction efficiency.

TABLE 1

| | | System 100 (prior art) | System 200 |
|---|---|---|---|
| Feed gas stream | Ref # | 102 | 202 |
| | P | 59.00 | 59.00 |
| | T | 33.13 | 33.65 |
| Column Pressure | Ref # | 136 | 236 |
| | P | 48.42 | 58.57 |
| Feed at Warm section outlet | Ref # | 145 | 245 |
| | P | 42.98 | 53.14 |
| | T | −72.54 | −52.78 |
| Feed at Economizer outlet | Ref # | | 246 |
| | P | — | 52.79 |
| | T | — | −71.53 |
| Reflux Drum | Ref # | 150 | 250 |
| | P | 42.98 | 46.26 |
| | T | −72.54 | −77.00 |
| Feed at Middle section inlet | Ref # | 151 | 257 |
| | P | 42.98 | 45.92 |
| | T | −72.54 | −53.87 |
| Specific Power, kWh/tonne | | 428.1 | 402.0 |
| Relative Spec Power | | 100.0% | 93.9% |

P: Pressure in bara
T: Temperature in degrees C.

It will be appreciated that the invention is not restricted to the details described above with reference to the preferred embodiments but that numerous modifications and variations can be made without departing from the spirit or scope of the invention as defined in the following claims.

The invention claimed is:

1. A method of steady state operation of a system for liquefying natural gas, the method comprising:

(a) performing a closed-loop compression sequence on a warm first refrigerant stream withdrawn from a warm side of a main heat exchanger, the compression sequence comprising compressing and cooling the warm first refrigerant stream to produce at least one cooled, compressed first refrigerant stream;

(b) withdrawing a natural gas feed stream from a natural gas feed source at a source pressure;

(c) introducing the natural gas feed stream into a scrub column at a scrub column pressure, the scrub column having a top section and a bottom section;

(d) separating the natural gas feed stream in the scrub column into a methane-rich vapor fraction, collected as a first overhead vapor stream at a top end of the scrub column, and a heavy hydrocarbon-enriched fraction, collected as a first bottoms liquid stream at a bottom end of the scrub column;

(e) withdrawing the first bottoms liquid stream from the scrub column, the first bottoms liquid stream being a heavy hydrocarbon enriched natural gas stream;

(f) withdrawing the first overhead vapor stream from the scrub column, the first overhead vapor stream being a methane-enriched natural gas stream;

(g) introducing at a warm end of a warm section of a main heat exchanger, the first overhead vapor stream into a natural gas circuit, and each of the at least one cooled-compressed first refrigerant stream into a refrigerant circuit;

(h) in at least one of the refrigerant circuits, withdrawing and reducing a pressure of an overhead refrigerant stream to produce a reduced pressure overhead refrigerant stream and introducing the reduced pressure overhead refrigerant stream into a cold side of the main heat exchanger;

(i) providing indirect heat exchange between the warm side and the cold side of the main heat exchanger;

(j) producing a product stream from the natural gas circuit at a cold end of the main heat exchanger, the product stream being at least partially liquefied;

(k) withdrawing a two-phase natural gas stream from the natural gas circuit at a cold end of the warm section of the main heat exchanger;

(l) reducing a pressure of the two-phase natural gas stream to form a reduced pressure two-phase natural gas stream;

(m) introducing the reduced pressure two-phase natural gas stream into a reflux drum at an intermediate natural gas temperature;

(n) separating the reduced pressure two-phase natural gas stream into a reflux drum liquid stream and a reflux drum vapor stream;

(o) introducing the reflux drum vapor stream into the natural gas circuit at a location in the main heat exchanger that is closer to a cold end of the main heat exchanger than the cold end of the warm section;

(p) increasing a pressure of the reflux drum liquid stream and introducing the reflux drum liquid stream into the top section of the scrub column; and (q) providing indirect heat exchange between the reflux drum vapor stream and the two-phase natural gas stream by which the two-phase natural gas stream is cooled against the reflux drum vapor stream.

2. The method of claim 1, further comprising:

(r) operationally configuring any valves located between, and in flow communication with, the natural gas feed source and the scrub column to provide a total pressure drop of no more than one bar.

3. The method of claim 1, further comprising:

(s) withdrawing a partially condensed refrigerant stream from one of the at least one refrigerant circuits at a cold end of the warm section of the main heat exchanger and at an intermediate refrigerant temperature;

(t) separating the partially condensed refrigerant stream in a phase separator into an intermediate liquid refrigerant stream and an intermediate vapor refrigerant stream;

(u) introducing each of the intermediate liquid refrigerant stream and the intermediate vapor refrigerant stream into a refrigerant circuit at a location in the main heat exchanger that is closer to the cold end of the main heat exchanger that the cold end of the warm section.

4. The method of claim 1, wherein step (i) further comprises:

(i) providing indirect heat exchange between the warm side and the cold side of the main heat exchanger, the warm side of the main heat exchanger comprising at least one coil-wound bundle and the cold side of the main heat exchanger comprising a shell-side, each refrigerant circuit and the natural gas circuit comprising a portion of the at least one coil-wound bundle.

5. The method of claim 4, wherein step (c) further comprises:

(c) separating the natural gas feed stream into a first portion and a second portion, introducing the first portion of the natural gas feed stream into the scrub column at an intermediate location and introducing the second portion of the natural gas feed stream into the bottom end of the scrub column.

6. The method of claim 5, further comprising:

(v) providing indirect heat exchange between the first overhead vapor stream and the first portion of the natural gas feed stream.

7. The method of claim 1, further comprising:

(w) pre-cooling the natural gas feed stream by indirect heat exchange against a second refrigerant before performing step (c).

8. The method of claim 1, further comprising:

(x) withdrawing a condensed natural gas stream from the natural gas circuit from a cold end of a middle section of the main heat exchanger, increasing the pressure of the condensed natural gas stream to form an increased pressure natural gas stream, and introducing the increased pressure natural gas stream into the reflux drum.

9. The method of claim 1, wherein step (p) comprises:

(p) increasing a pressure of the reflux drum liquid stream, splitting the reflux drum liquid stream into a first portion and second portion, introducing the first portion of the reflux drum liquid stream into the top section of the scrub column, and mixing the second portion of the reflux drum liquid stream with the reflux drum vapor stream before performing step (o).

10. The method of claim 9, further comprising:

(y) Performing an indirect heat exchange between the two-phase natural gas stream and a third refrigerant before performing step (1).

11. The method of claim 1, wherein step (h) further comprises splitting at least one of the reduced pressure overhead refrigerant streams into a first portion and a second portion, introducing the first portion into the cold side of the main heat exchanger, performing an indirect heat exchange between the second portion, the reflux drum vapor stream and the two-phase natural gas stream.

12. The method of claim 1, further comprising:

(z) Increasing a pressure of the natural gas feed stream using a compressor before performing step (c).

* * * * *